US010995724B2

(12) United States Patent
Adachi et al.

(10) Patent No.: US 10,995,724 B2
(45) Date of Patent: May 4, 2021

(54) IGNITER ASSEMBLY AND IGNITER UNIT

(71) Applicant: DIAMOND ELECTRIC MFG. CO., LTD., Osaka (JP)

(72) Inventors: Kohei Adachi, Osaka (JP); Hiroshi Morita, Osaka (JP); Kazutoshi Hosoda, Osaka (JP)

(73) Assignee: DIAMOND ELECTRIC MFG. CO., LTD, Osaka (JP)

( * ) Notice: Subject to any disclaimer, the term of this patent is extended or adjusted under 35 U.S.C. 154(b) by 0 days.

(21) Appl. No.: 16/702,030

(22) Filed: Dec. 3, 2019

(65) Prior Publication Data

US 2020/0173416 A1 Jun. 4, 2020

(30) Foreign Application Priority Data

Dec. 4, 2018 (JP) ..... JP2018-226977

(51) Int. Cl.
*F02P 3/02* (2006.01)
*H01F 38/12* (2006.01)

(52) U.S. Cl.
CPC ..... *F02P 3/02* (2013.01); *H01F 38/12* (2013.01)

(58) Field of Classification Search
CPC ..... F02P 3/02; F02P 7/07; H01F 38/12; F02N 15/006; F02N 2200/021; F02N 11/04; F02N 19/004
See application file for complete search history.

(56) References Cited

U.S. PATENT DOCUMENTS 5,497,756 A * 3/1996 Matthiesen ..... H01F 27/06 123/634
7,036,495 B1 * 5/2006 Shimizu ..... H01T 13/05 123/260
7,213,558 B2 * 5/2007 Iwata ..... F02M 35/10032 123/184.55
7,383,830 B2 * 6/2008 Matsui ..... H01F 27/29 123/143 B
10,608,415 B2 * 3/2020 Schumm ..... H01T 13/04
2003/0192519 A1 * 10/2003 Katayama ..... F02P 3/02 123/634
2007/0023019 A1 * 2/2007 Hamada ..... H01F 38/12 123/634
2007/0181109 A1 * 8/2007 Matsui ..... H01F 38/12 123/634
2008/0006254 A1 * 1/2008 Matsui ..... H01F 38/12 123/634
2009/0108972 A1 * 4/2009 Wada ..... H01F 38/12 336/90

FOREIGN PATENT DOCUMENTS

JP 2012-147025 A 8/2012
JP 2017059681 A * 3/2017 ..... H01F 38/12

* cited by examiner

*Primary Examiner* — Joseph J Dallo
(74) *Attorney, Agent, or Firm* — Birch, Stewart, Kolasch & Birch LLP

(57) ABSTRACT

This igniter assembly 220 includes: an igniter 2 provided with a lead terminal 20; a body 1 made of resin and storing the igniter 2; and an internal terminal 3 fixed to the body 1 and having one end electrically connected to the lead terminal 20. The internal terminal 3 has another end extending outward of the body 1.

5 Claims, 5 Drawing Sheets

IGNITER ASSEMBLY AND IGNITER UNIT

This application claims priority on Patent Application No. 2018-226977 filed in JAPAN on Dec. 4, 2018. The entire contents of this Japanese Patent Application are hereby incorporated by reference.

BACKGROUND OF THE INVENTION

Field of the Invention

The present invention relates to igniter units provided to internal combustion engine ignition coils.

Description of the Related Art

In an internal combustion engine ignition coil, intermittent control of a primary current to be supplied to a coil assembly is performed by an igniter. By the intermittent control, a high voltage is generated in the coil assembly. Here, the intermittent control by the igniter is performed according to a signal transmitted from an ECU. The signal transmitted from the ECU is inputted to the igniter via a connector terminal provided to a connector case. Therefore, in the ignition coil, it is desired that connection between the igniter and an external terminal (connector terminal) is ensured.

For example, in technology described in Japanese Laid-Open Patent Publication No. 2012-147025, a case (connector case), which has an igniter storage portion, provides a protrusion, and the position of a molding portion (package) of an igniter is determined by the protrusion. This ensures connection between the igniter and an external terminal.

However, the outer dimensions of igniters differ among the products (part numbers). Therefore, in the technology described in Japanese Laid-Open Patent Publication No. 2012-147025, if the igniter to be used is changed, it is necessary to change the shape of the connector case in accordance with the outer dimensions of the changed igniter.

The present invention has been made in view of the above circumstances, and an object of the present invention is to provide technology that allows an igniter to be easily mounted to an igniter assembly (igniter unit).

SUMMARY OF THE INVENTION

In order to achieve the above object, one aspect of an igniter assembly according to the present invention includes: an igniter provided with a lead terminal; a body made of resin and storing the igniter; and an internal terminal fixed to the body and having one end electrically connected to the lead terminal, wherein the internal terminal has another end extending outward of the body.

Preferably, the igniter assembly further includes an electronic component stored in the body.

Preferably, at least one of the lead terminal and the internal terminal has a through hole, and the electronic component includes a connection terminal, and the connection terminal is inserted into the through hole.

Preferably, the igniter assembly includes a shield layer covering a periphery of the body from an outer side.

Preferably, the igniter assembly includes an elastomer cover provided on an outer side of the shield layer.

Preferably, the body has a box shape having an opened surface.

One aspect of an igniter unit according to the present invention is an igniter unit including: the above igniter assembly; and a connector case made of resin, wherein the connector case has a storage portion storing the igniter assembly, and a connector portion molded integrally with the storage portion.

According to the present invention, the igniter is stored in the body. Therefore, even if the outer dimensions of the package are changed, it is possible to store the igniter in the body by merely changing the shape of the body (that is, without making any change in the igniter and the connector case). As a result, the igniter can be easily applied to the ignition coil.

In one embodiment of the present invention, an electronic component can be stored in the body. Even if an electronic component that is separate from a package of the igniter needs to be added to an internal combustion engine ignition coil, it is possible to mount it without changing the package shape of the igniter and the shape of the connector case.

In one embodiment of the present invention, the connection terminal of the electronic component can be inserted into the through hole provided in at least one of the lead terminal and the internal terminal. The electronic component and the lead terminal or the electronic component and the internal terminal can be connected by filling the through hole with solder. Here, solder can be supplied into the through hole from either of two openings of the through hole. Therefore, in a manufacturing process for the igniter assembly, connection (attachment) of the electronic component is facilitated.

In one embodiment of the present invention, the igniter assembly has a shield layer covering the periphery of the body from an outer side. The large area can be covered by the shield layer. As a result, the shield effect by the shield layer is increased. Since the igniter and the electronic component are stored in the body, the igniter and the electronic component are also covered by the shield layer. As a result, both of the igniter and the electronic component can be shielded from external noise.

In one embodiment of the present invention, the igniter assembly has an elastomer cover provided on the outer side of the shield layer. While the body (igniter and electronic component) are shielded by the shield layer, occurrence of cracks in filler resin filling the inside of the ignition coil can be suppressed by the elastomer cover.

DESCRIPTION OF THE PREFERRED EMBODIMENTS

The following will describe in detail the present invention based on preferred embodiments with reference to the accompanying drawings.

<<1. Internal Combustion Engine Ignition Coil>>

Figure 1:
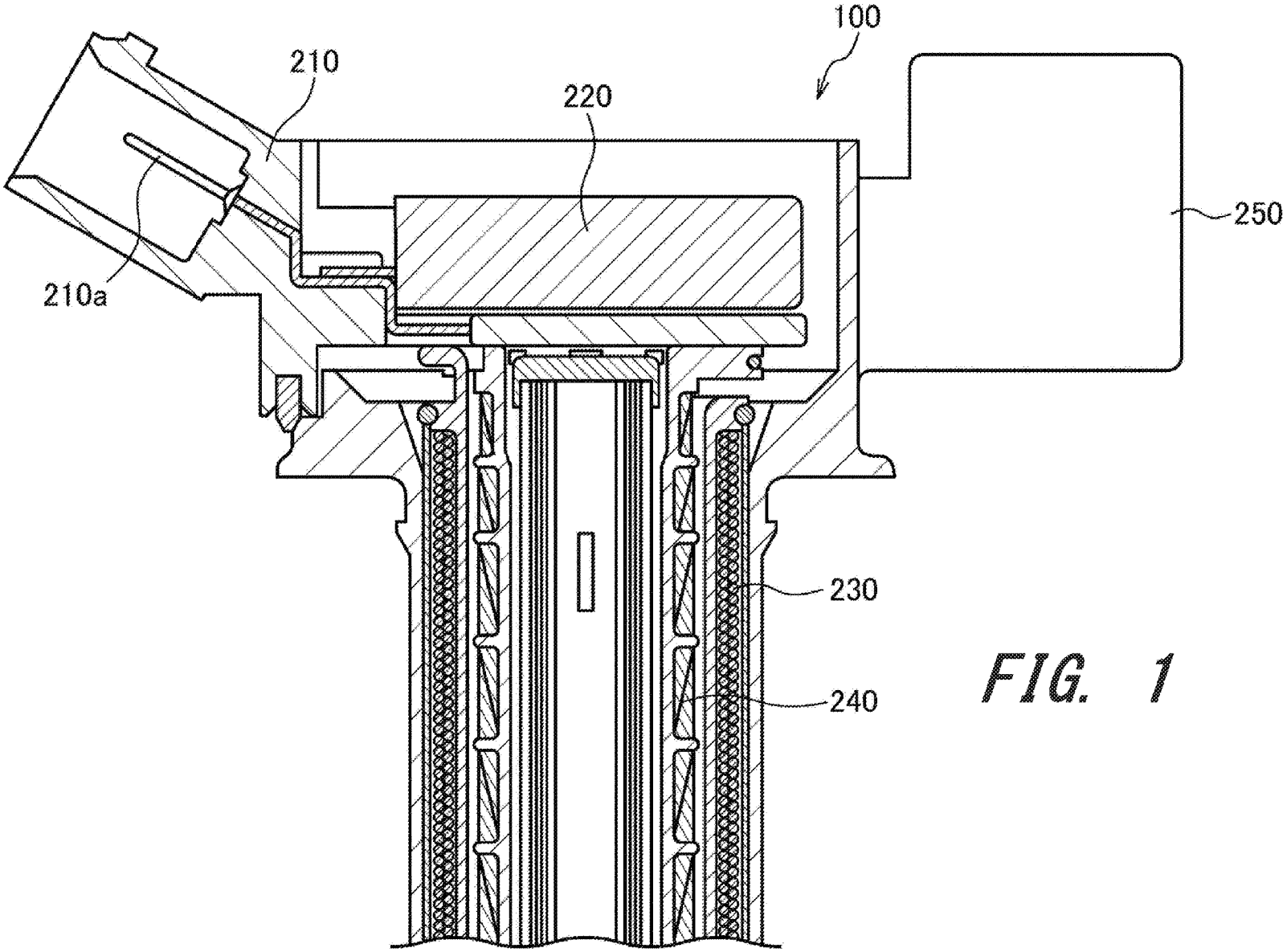
FIG. 1 is a sectional view of an internal combustion engine ignition coil according to an embodiment.

FIG. 1 is a sectional view of an internal combustion engine ignition coil 100 according to an embodiment. The internal combustion engine ignition coil 100 (hereinafter, simply referred to as "ignition coil 100") is a device that applies a high voltage generated inside the ignition coil 100 to a spark plug (not shown), to generate spark discharge. As shown in FIG. 1, the ignition coil 100 includes a connector case 210, an igniter assembly 220, a primary coil 230, a secondary coil 240, a case 250, and the like.

The connector case 210 has a plurality of connector terminals 210*a*. The connector terminals 210*a* are connected to an electronic device such as an engine control unit (ECU) via a wire harness (not shown). Thus, an input voltage or a signal from the ECU is inputted to the ignition coil 100.

The igniter assembly 220 includes an igniter described later and is stored in the connector case 210. The igniter assembly 220 will be described in detail in first to third embodiments described later. The igniter assembly 220 (igniter) interrupts current application to the primary coil 230 according to a signal from the ECU, thereby induces a high voltage on the secondary coil 240. The high voltage induced on the secondary coil 240 is applied to the spark plug.

The connector case 210, the primary coil 230, and the like are fixed to or stored in the case 250. A space in the case 250 in which components such as the primary coil 230 and the like have been stored are filled with filler resin such as epoxy resin or the like, so that an insulation resin layer (not shown) is formed in the case 250.

<<2. Igniter Assembly>>

<2-1. First Embodiment (Basic Structure)>

Figure 2:
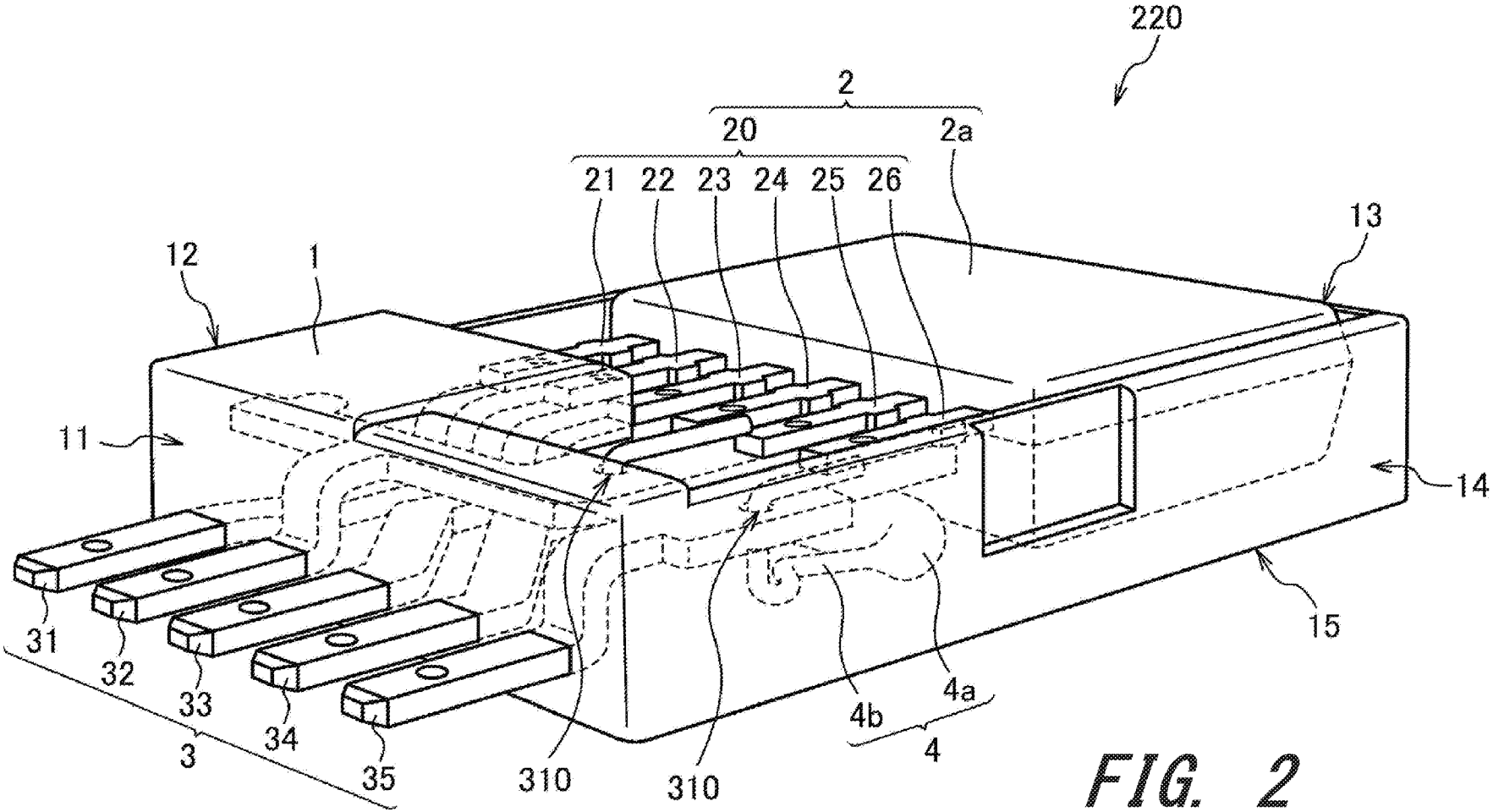
FIG. 2 is a view of an igniter assembly according to a first embodiment.

FIG. 2 is a view of the igniter assembly 220 according to the first embodiment. In FIG. 2, parts indicated by dotted lines show the internal structure of the igniter assembly 220. As shown in FIG. 2, the igniter assembly 220 according to the first embodiment includes a body 1, an igniter 2, internal terminals 3, and an electronic component 4. The igniter 2 and the electronic component 4 stored in the body 1 are electrically connected via the internal terminals 3 to other parts (parts other than the igniter assembly 220) stored in the ignition coil 100. The details of each component composing the igniter assembly 220 will be described below.

The body 1 is formed from a nonconductive material such as resin material or the like, for example. As shown in FIG. 2, the body 1 has substantially a box shape whose top surface is opened. The body 1 is formed by side surfaces 11, 12, 13, 14 and a bottom surface 15, and stores the igniter 2 and the electronic component 4 therein. The plurality of internal terminals 3 are fixed to the body 1. More specifically, the plurality of internal terminals 3 are fixed to the body 1 such that one end of each internal terminal 3 extends outward of an open area defined by a structure portion of the body 1. In the present embodiment, one end of each internal terminal 3 extends outward of an open area defined (surrounded) by the side surfaces 11, 12, 13, 14 and the bottom surface 15 of the body 1. In other words, each internal terminal 3 is fixed to the body 1 such that one end thereof protrudes from the side surface 11 of the body 1. The side surface 11 is referred to as terminal surface 11.

Examples of methods for fixing the internal terminals 3 include integrally forming the body 1 and the internal terminals 3 by insert molding. The body 1 is formed from a nonconductive material. Therefore, even when the plurality of internal terminals 3 are embedded in the body 1 as described above, a current is not conducted between the internal terminals 3.

The igniter 2 includes a package 2*a* molded with an insulation resin so as to include a circuit for performing intermittent control of a primary current, and a plurality of lead terminals 20 protruding from the package 2*a*. In the present embodiment, the lead terminals 20 are composed of six lead terminals 21, 22, 23, 24, 25, 26.

The outer dimensions of the packages of igniters differ among the products (part numbers). In general, if the part number of the igniter is changed, it is necessary to change the shape of the connector case in accordance with the outer dimensions of the changed igniter.

In the present embodiment, the igniter 2 is stored in the body 1. Therefore, even if the outer dimensions of the package 2*a* are changed, it is possible to store the igniter 2 in the body 1 by merely changing the shape of the body 1 (that is, without making any change in the igniter 2 and the connector case 210). As a result, the igniter 2 can be easily applied to the ignition coil 100.

The igniter 2 is positioned by the package 2*a* being fixed by a protrusion (not shown) provided in an internal area of the body 1, for example. In the example shown in FIG. 2, six lead terminals 20 are provided, but the number of the lead terminals 20 is not limited to six.

As described above, the internal terminals 3 are fixed to the body 1. In the present embodiment, the internal terminals 3 are composed of five internal terminals 31, 32, 33, 34, 35.

The internal terminals 3 make electric connection between: the igniter 2 and the electronic component 4 stored in the body 1; and terminals (connector terminals 210*a* and input-side terminal of primary coil 230) that are connected to the igniter assembly 220. In more detail, one end of each internal terminal 3 is electrically connected to the connector terminal 210*a* or the like, at a part (hereinafter, may be referred to as "area outside the body 1") outside the open area defined by the structure portion of the body 1. The other end of the internal terminal 3 is electrically connected to the lead terminal 20 of the igniter 2, in the area inside the body 1.

The internal terminal 3 may have a bending portion so that the internal terminal 3 has a rising (or falling) shape. In general, in the case where the height at which the connector terminal 210*a* extends and the height at which the lead terminal 20 of the igniter 2 extends are different from each other, the connector terminal 210*a* and the lead terminal 20 cannot be electrically connected to each other, unless the shape of the connector terminal 210*a* or the lead terminal 20 is changed. However, in the present embodiment, since the internal terminal 3 has the bending portion, it is possible to electrically connect the connector terminal 210*a* and the lead terminal 20 of the igniter 2 via the internal terminal 3, without making any change in the connector case 210 (connector terminal 210*a*) and the igniter 2 (lead terminal 20).

With the bending portion provided to the internal terminal 3, the internal terminal 3 may extend so as to pass over (or under) another internal terminal 3. Thus, the arrangement order of the internal terminals 3 at outside the body 1 and that of the internal terminals 3 at inside the body 1 may be different. That is, by forming at least one of the plurality of internal terminals 3 so as to pass over (or under) another internal terminal 3, the arrangement order of the internal terminals 3 can be changed.

In general, in the case where the terminal arrangement order of lead terminals 20 (i.e., arrangement order of input/output terminals of the igniter 2) and that of the corresponding connector terminals 210*a* are different, it is necessary to make some change in the igniter 2 or the connector terminals 210*a* in order to match both terminal arrangement order.

However, in the present embodiment, even if the terminal arrangement order of the lead terminals 20 and that of the corresponding connector terminals 210*a* are different, it is possible to electrically connect the lead terminals 20 of the igniter 2 and the corresponding connector terminals 210*a* by changing the shapes of the internal terminals 3, without making any change in the igniter 2 and the connector terminals 210*a*. In addition, in the present embodiment, also in the case where the terminal arrangement order of the lead terminals 20 is changed when the igniter 2 is changed, it is possible to electrically connect the igniter 2 and the connector terminals 210*a* without making any change in the lead terminals of the igniter 2 and the connector terminals 210*a*.

Each internal terminal 3 may have any shape as long as the internal terminals 3 don't contact with each other, and is not limited to the shape shown in FIG. 2. For example, the internal terminal 3 may have no bending portion. As in the internal terminal 32, the internal terminal 3 may be formed in a fork shape.

In the example shown in FIG. 2, each internal terminal 3 has one bending portion. With this form, the internal terminal 31 is electrically connected to the corresponding lead terminal 21. The internal terminal 32 is formed in such a shape as to pass over the two internal terminals 33, 34 and is electrically connected to the corresponding lead terminal 25. The internal terminal 33 is formed in such a shape as to pass under the internal terminal 32 and is electrically connected to the corresponding lead terminal 23. The internal terminal 34 is formed in such a shape as to pass under the internal terminal 32, and is electrically connected to the corresponding lead terminal 22. Here, the positions of the bending portions of the internal terminals 33, 34 are on the igniter 2 side with respect to the position of the bending portion of the internal terminal 32. Therefore, the internal terminals 33, 34 do not contact with the internal terminal 32. The internal terminal 35 is electrically connected to the corresponding lead terminal 26.

The electronic component 4 is separate from the package 2*a* of the igniter 2. Specific examples of the electronic component 4 include a capacitor and a diode. As described above, the electronic component 4 is stored in the body 1.

In the present embodiment, the electronic component 4 is stored in the body 1. Therefore, even in the case where the electronic component 4 that is separate from the package 2*a* of the igniter 2 needs to be added to the ignition coil 100, it is possible to mount it without changing the shape of the package 2*a* of the igniter 2 and the shape of the connector case 210.

The electronic component 4 is composed of an electronic component body 4*a* and a connection terminal 4*b* for connecting the electronic component body 4*a* to another component. The connection terminal 4*b* is inserted into a through hole 310 provided in the internal terminal 3 or the lead terminal 20. In the example shown in FIG. 2, the electronic component 4 has two connection terminals 4*b*, and each of the internal terminals 32, 35 has one through hole 310.

In the present embodiment, each connection terminal 4*b* of the electronic component 4 is inserted into the through hole 310 of the lead terminal 20 or the through hole 310 of the internal terminal 3 as described above. The electronic component 4 and the lead terminal 20 or the electronic component 4 and the internal terminal 3 can be connected by filling the through holes 310 with solder. Here, solder can be supplied into each through hole 310 from either of two openings of the through hole 310. Therefore, in a manufacturing process for the igniter assembly 220, connection (attachment) of the electronic component 4 is facilitated. In addition, in the present embodiment, since solder can be supplied from either of two openings of each through hole 310, choices for the location where the electronic component 4 is provided can be broadened.

In the present embodiment, the electronic component 4 is stored in the body 1. Even in the case where the electronic component 4 is not stored in the body 1, the above effect obtained by inserting the connection terminals 4*b* of the electronic component 4 into the through holes 310 can be obtained.

In the example shown in FIG. 2, one through hole 310 is provided in each of the two internal terminals 3 (internal terminals 32, 35). One through hole 310 may be provided in each of two lead terminals 20, or one through hole 310 may be provided to each of one lead terminal 20 and one internal terminal 3.

The width of the lead terminal 20 or the internal terminal 3 at a part of the terminal around the through hole 310 may be set to be greater (wider) than that at the other parts of the terminal. Thus, wider width of the lead terminal 20 or the internal terminal 3 terminal at a part around the through hole 310 can ensure the strengths of the terminal.

The bottom surface 15 of the body 1 may have an opening hole through which the lead terminal 20 or the internal terminal 3 is exposed. In the case where the bottom surface 15 of the body 1 has an opening hole through which the lead terminal 20 or the internal terminal 3 is exposed, for example, it is possible to store the electronic component 4 into the body 1 through the opening hole. In addition, it is possible to solder the electronic component 4 and the internal terminal 3 or lead terminal 20 with each other through the opening hole. That is, the assembling work for the igniter assembly 220 can be performed from either of "an opened surface of the body 1" or "the opening hole provided in the bottom surface 15 of the body 1". As a result, assembling of the igniter assembly 220 is facilitated.

<2-2. Second Embodiment (Shield Layer)>

Figure 3:
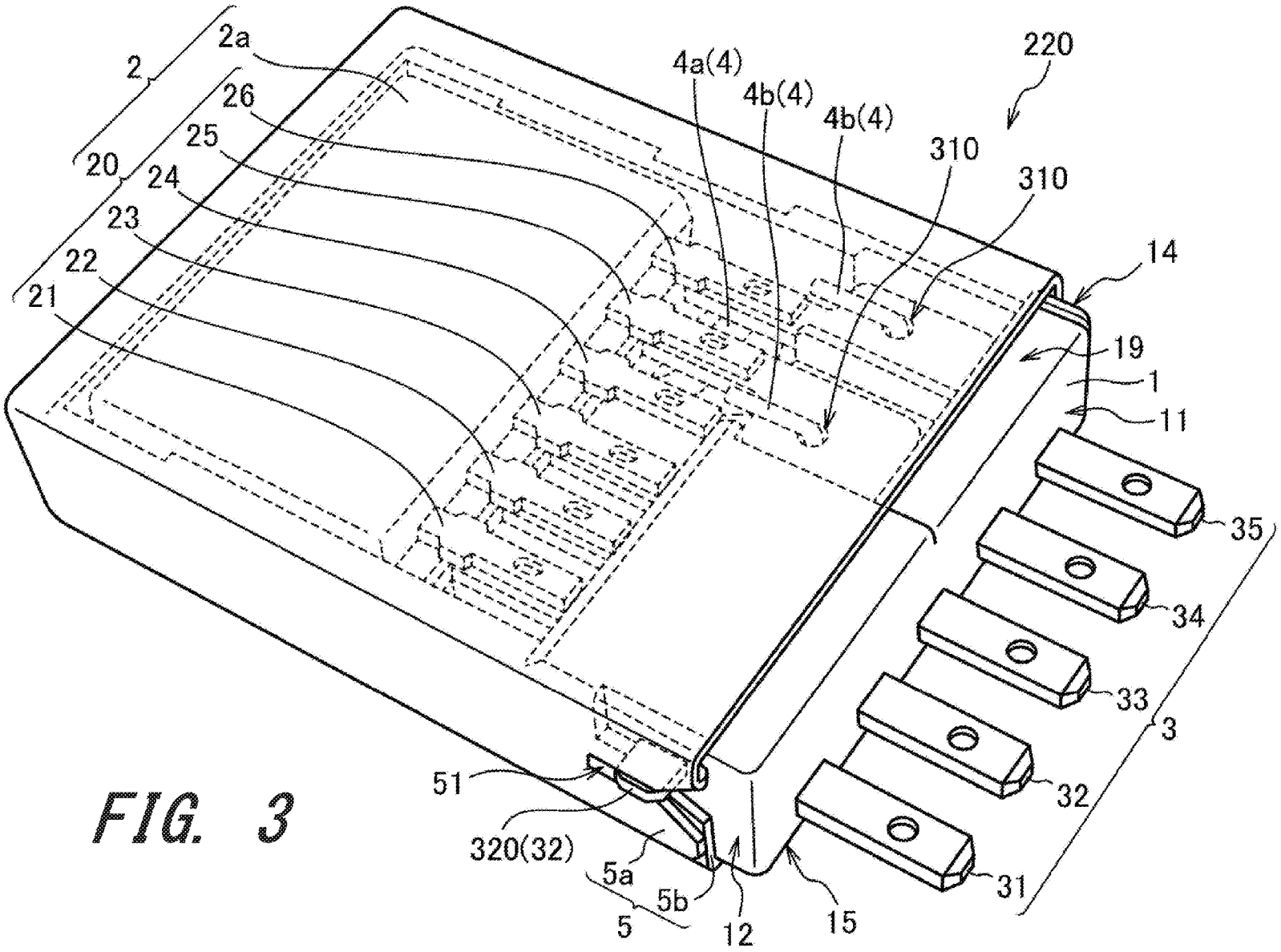
FIG. 3 is a view of an igniter assembly according to a second embodiment.

Next, the igniter assembly 220 according to the second embodiment will be described. FIG. 3 is a view of the igniter assembly 220 according to the second embodiment. In FIG. 3, parts indicated by dotted lines show the internal structure of the igniter assembly 220. The igniter assembly 220 according to the second embodiment is configured such that a shield layer 5 for surrounding the periphery of the body 1 from the outer side is provided to the igniter assembly 220 according to the first embodiment.

The shield layer 5 in the present embodiment is formed from a metal material such as copper or the like, and has a box shape in which one of four side surfaces is opened as shown in FIG. 3. By inserting the body 1 according to the first embodiment through the opened surface (shield opening) of the shield layer 5, five surfaces (three side surfaces and two main surfaces) of the body 1 are covered by the shield layer 5. In more detail, the shield layer 5 covers the body 1 except for the side surface 11 (terminal surface 11) from which the internal terminals 3 protrude, and portions of the internal terminals 3 that are stored in the body 1. Here, the side surface 11 (terminal surface 11) exposed from the shield layer 5 is a surface with the smallest area among the surfaces of the body 1. The larger the area covered by the shield layer 5 is, the greater the shield effect by the shield layer 5 is. Therefore, as shown in the present embodiment, by covering the surfaces other than the side surface 11 (terminal surface 11) that has the smallest area among the surfaces of the body 1 by the shield layer 5, the shield effect can be increased.

Thus, in the present embodiment in which the igniter assembly 220 has the shield layer 5 surrounding the periphery of the body 1 from the outer side, the area covered by the shield layer 5 is large. As a result, the shield effect by the shield layer 5 is increased. In addition, since the igniter 2 and the electronic component 4 are stored in the body 1, the igniter 2 and the electronic component 4 are also covered by the shield layer 5. As a result, both of the igniter 2 and the electronic component 4 are shielded from external noise.

In the present embodiment, the entire body 1 except for the side surface 11 (terminal surface 11) is covered by the shield layer 5 described above. Portions of the body 1 other than the side surface 11 (terminal surface 11) may be exposed. For example, the side surface 12 of the body 1 may be exposed. As described above, the larger the area covered by the shield layer 5 is, the greater the shield effect by the shield layer 5 is. Therefore, it is preferable that the area covered by the shield layer 5 is set to be as large as possible.

In the present embodiment, the side surface 11 (terminal surface 11) is not covered by the shield layer 5. At least a part of the side surface 11 may be covered by the shield layer 5. Since the shield layer 5 is formed from a metal material as described above, contact between the shield layer 5 and the internal terminals 3 should be prevented. It is noted that the shield layer 5 exemplified in FIG. 3 is composed of two layers, i.e., an outer shield 5*a* and an inner shield 5*b*. The shield layer 5 may be composed of one layer.

Next, fixation between the shield layer 5 and the body 1 will be described. As shown in FIG. 3, a projection 320 projects from an outer surface of the body 1. The projection 320 is a part of one of the internal terminals 3 (in the example shown in FIG. 2, the internal terminal 32). The shield layer 5 has a cutout 51 in which the projection 320 is fitted (press-fitted). In more detail, as shown in FIG. 3, the cutout 51 is provided at such a position that the projection 320 is fitted (press-fitted) thereto when the body 1 is inserted through the opening of the shield layer 5. Thus, the shield layer 5 and the body 1 are fixed to each other with such a simple structure that the projection 320 is fitted in the cutout 51.

In the present embodiment, the internal terminal 32 for the projection 320 is connected to one of the connector terminals 210*a* that is a ground terminal. Thus, in the present embodiment, since the internal terminal 35 for the projection 320 is connected to the ground, it is possible to electrically ground the shield layer 5 with such a simple structure that the projection 320 is fitted in the cutout 51 as described above.

For forming the projection 320 to project from a side surface of the body 1, it is not necessary to provide a bending portion to the internal terminal 32, but the internal terminal 32 only needs to extend toward a desired side surface from which the projection 320 is to project. That is, by projecting the projection 320 from a side surface of the body 1, the number of bending portions provided to the internal terminals 3 can be decreased. As a result, the number of times a bending work is performed in manufacturing of the internal terminals 3 can be decreased, whereby the manufacturing of the internal terminals 3 is facilitated.

Preferably, a gap 19 through which filler resin is supplied is provided between the shield layer 5 and the body 1 at the opened surface of the shield layer 5, as shown in FIG. 3. By providing the gap 19, the inside of the body 1 can be easily filled with filler resin even though the body 1 is covered by the shield layer 5.

<2-3. Third Embodiment (Elastomer Cover)>

Figure 4:
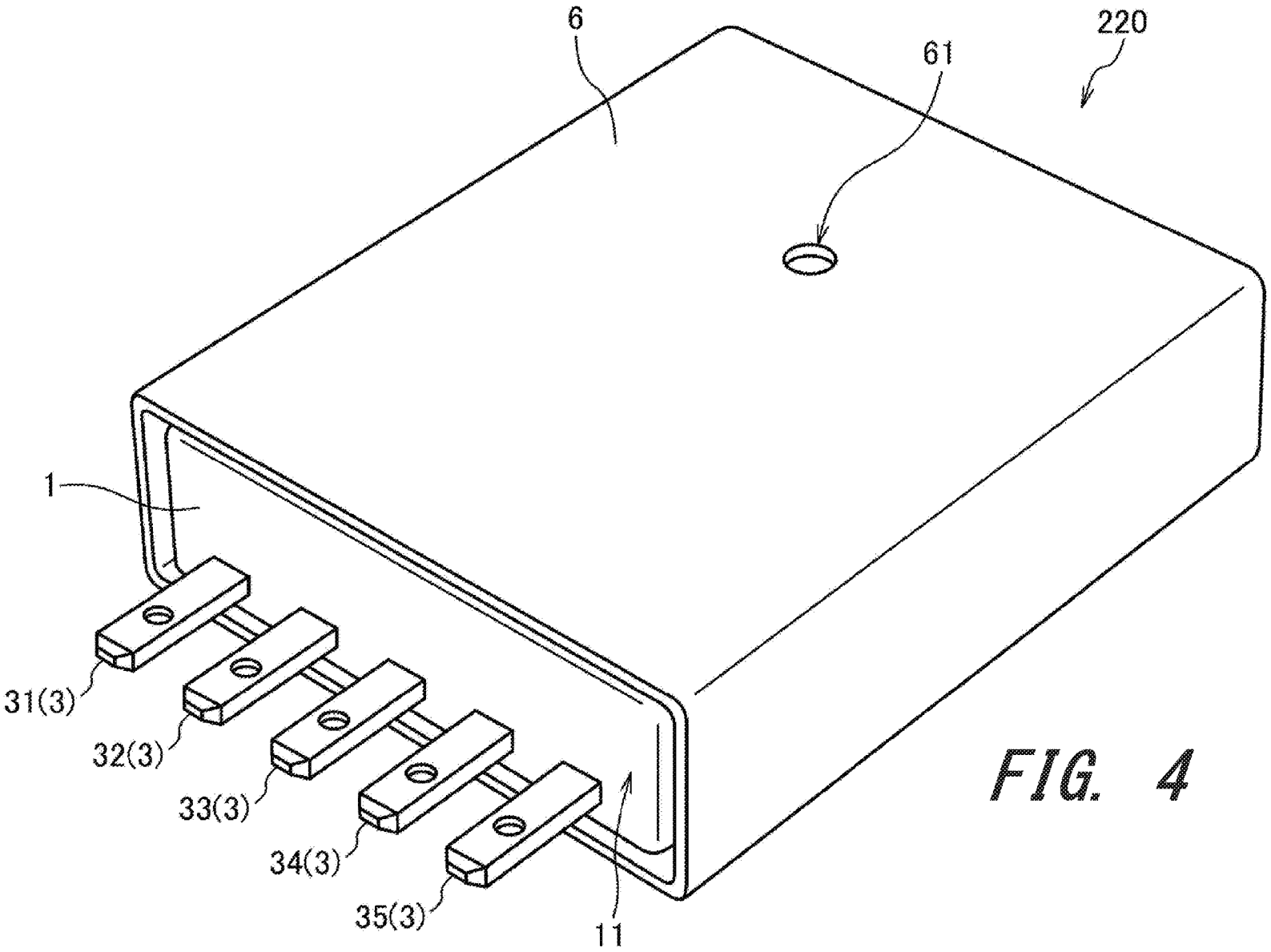
FIG. 4 is a view of an igniter assembly according to a third embodiment.

Next, the igniter assembly 220 according to the third embodiment will be described. FIG. 4 is a view of the igniter assembly 220 according to the third embodiment. The igniter assembly 220 according to the third embodiment is configured such that an elastomer cover 6 is provided on the outer side of the shield layer 5 of the igniter assembly 220 according to the second embodiment. By providing the elastic elastomer cover 6 on the outer side of the shield layer 5 as described above, occurrence of cracks in the filler resin due to thermal extension/contraction of the shield layer 5 can be suppressed.

In the present embodiment, as shown in FIG. 4, the elastomer cover 6 has a box shape in which one of four side surfaces is opened. By inserting the igniter assembly 220 according to the second embodiment through an opened face (cover opening) of the elastomer cover 6, the shield layer 5 is covered by the elastomer cover 6. As in the shield layer 5, the elastomer cover 6 in the present embodiment has such a shape that only outer portions of the internal terminals 3 and the terminal surface 11 of the body 1 are exposed, and thus covers the entire outer surface of the shield layer 5. Thus, since the area of the shield layer 5 that is covered by the elastomer cover 6 is set to be large, cracks are less likely to occur in the filler resin.

In the present embodiment, while the body 1 (igniter 2 and electronic component 4) is shielded by the shield layer 5, occurrence of cracks in the filler resin filling the inside of the ignition coil 100 (case 250) can be suppressed by the elastomer cover 6.

It is preferable that an air discharge hole 61 is provided in the elastomer cover 6. By providing the air discharge hole 61 in the elastomer cover 6, air is discharged through the air discharge hole 61 when the filler resin is supplied to the ignition coil 100. Thus, the inside of the igniter assembly 220 can be readily filled with the filler resin.

<<3. Igniter Unit>>

Figure 5:
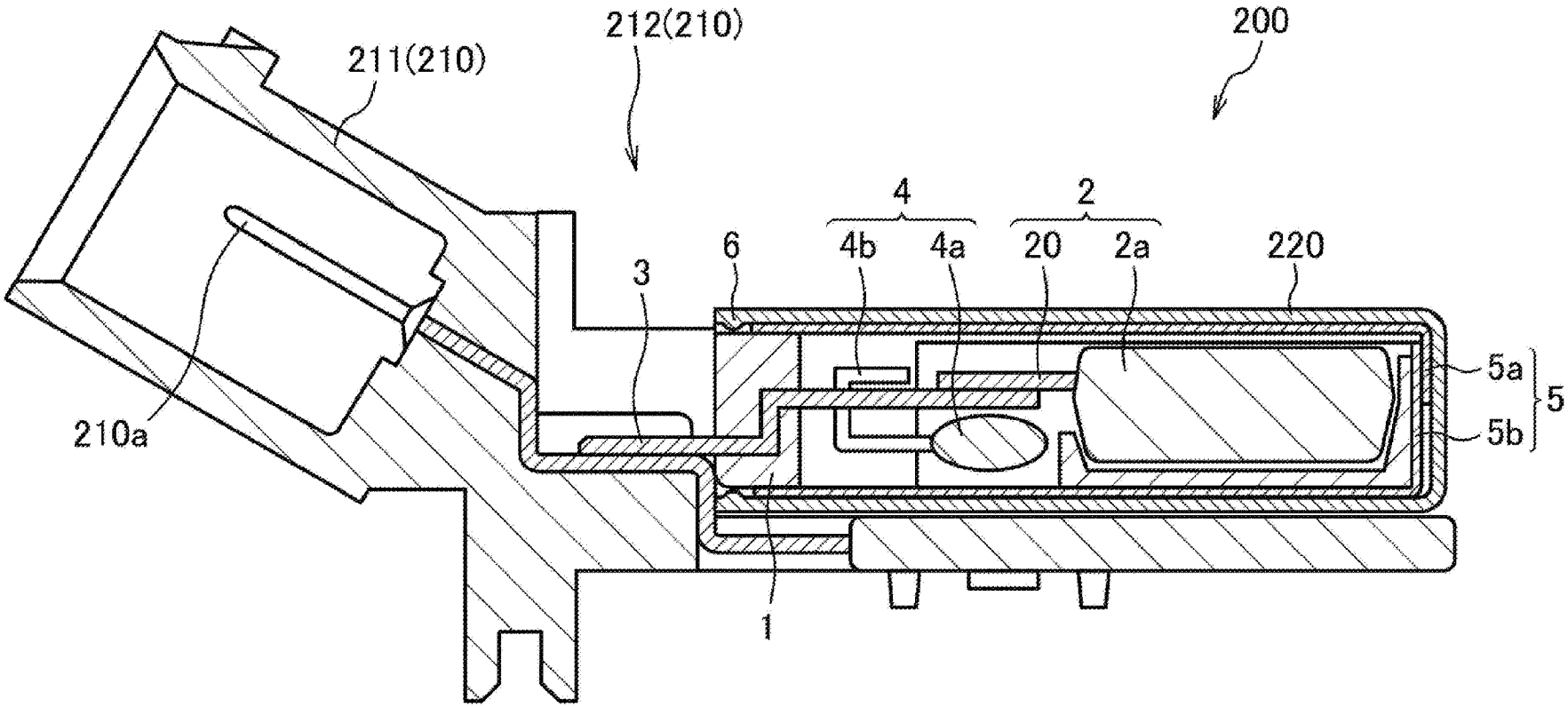
FIG. 5 is a view of an igniter unit including the igniter assembly shown in FIG. 4.

Here, the igniter unit 200 will be described. FIG. 5 is a view of the igniter unit 200 including the igniter assembly 220 according to the third embodiment. The igniter unit 200 is composed of the connector case 210 and the igniter assembly 220.

The connector case 210 is formed from resin, and as shown in FIG. 5, has a connector portion 211 and a storage portion 212. The connector portion 211 is molded integrally with the storage portion 212, and the plurality of connector terminals 210*a* are disposed inside the connector portion 211. The connector terminals 210*a* are provided integrally with the connector case 210 (connector portion 211) by insert molding. When the igniter unit 200 is fixed to the case 250, at least a part of the connector portion 211 is exposed from the case 250 (see FIG. 1).

The storage portion 212 stores the igniter assembly 220. When the igniter unit 200 is fixed to the case 250, the storage portion 212 is stored inside the case 250 (see FIG. 1). In the example shown in FIG. 5, the igniter assembly 220 according to the third embodiment is shown. The igniter assembly 220 to be stored in the storage portion 212 is not limited to the igniter assembly 220 according to the third embodiment. For example, the igniter assembly 220 according to the first embodiment may be stored in the storage portion 212, or the igniter assembly 220 according to the second embodiment may be stored in the storage portion 212.

The above descriptions are merely illustrative examples, and various modifications can be made without departing from the principles of the present invention.

What is claimed is:

1. An igniter assembly comprising:

an igniter provided with a lead terminal;

a body made of resin and storing the igniter;

an electronic component stored in the body; and an internal terminal fixed to the body and having one end electrically connected to the lead terminal, wherein the internal terminal has another end extending outward of the body, at least one of the lead terminal and the internal terminal has a through hole, and the electronic component includes a connection terminal, and the connection terminal is inserted into the through hole.

2. The igniter assembly according to claim 1, further comprising a shield layer covering a periphery of the body from an outer side.

3. The igniter assembly according to claim 2, further comprising an elastomer cover provided on an outer side of the shield layer.

4. The igniter assembly according to claim 1, wherein the body has a box shape having an opened surface.

5. An igniter unit comprising:

the igniter assembly according to claim 1; and a connector case made of resin, wherein the connector case has a storage portion storing the igniter assembly, and a connector portion molded integrally with the storage portion.

* * * * *